US005762565A

United States Patent [19]

Milam et al.

[11] Patent Number: 5,762,565

[45] Date of Patent: Jun. 9, 1998

[54] GOLF SWING TRAINING DEVICE

[76] Inventors: James D. Milam; Brian M. Milam, both of 22 3rd St. North, Humboldt, Iowa 50548

[21] Appl. No.: 687,147

[22] Filed: Jul. 24, 1996

[51] Int. Cl.[6] ..... A63B 69/36

[52] U.S. Cl. ..... 473/271; 473/277; 473/269

[58] Field of Search ..... 473/277, 269, 473/271, 272

[56] References Cited

U.S. PATENT DOCUMENTS

| | | | |
|---|---|---|---|
| 2,611,610 | 9/1952 | Hara | 473/277 X |
| 3,215,438 | 11/1965 | Sheldon et al. | 473/277 |
| 5,092,601 | 3/1992 | Rilling . | |
| 5,221,089 | 6/1993 | Barrett . | |
| 5,263,720 | 11/1993 | Rothermel . | |
| 5,288,074 | 2/1994 | Scheurer | 473/277 |
| 5,294,125 | 3/1994 | Mietz . | |
| 5,303,927 | 4/1994 | Perry et al. . | |
| 5,308,074 | 5/1994 | Dorotinsky et al. . | |

*Primary Examiner*—George J. Marlo

*Attorney, Agent, or Firm*—Andrus, Sceales, Starke & Sawall

[57] ABSTRACT

A golf swing training device for monitoring the amount of forward hip movement during a completed golf swing. The golf swing training device includes a hip pad support structure pivotally mounted to a stationary base. The stationary base includes a pair of foot guides which correctly position the golfer with respect to the swing training device. A hip pad is connected to a horizontal arm of the hip pad support structure and is positioned to engage the front hip of the golfer. The position of the hip pad can be adjusted in both the vertical and horizontal direction depending upon the physical characteristics of the golfer using the swing training device. During a completed golf swing, the golfer's front hip applies force to the hip pad if the golfer slides his or her hips forward during the swing, which results in the hip pad support structure rotating about its pivotal connection to the base. Preferably, a visual and/or an audio feedback device provides the golfer with an indication of the amount of forward hip movement present during the golf swing. By repeating his or her golf swing, the golfer can concentrate on reducing the amount of forward hip movement to create a more efficient and powerful golf swing.

19 Claims, 2 Drawing Sheets

FIG. 1
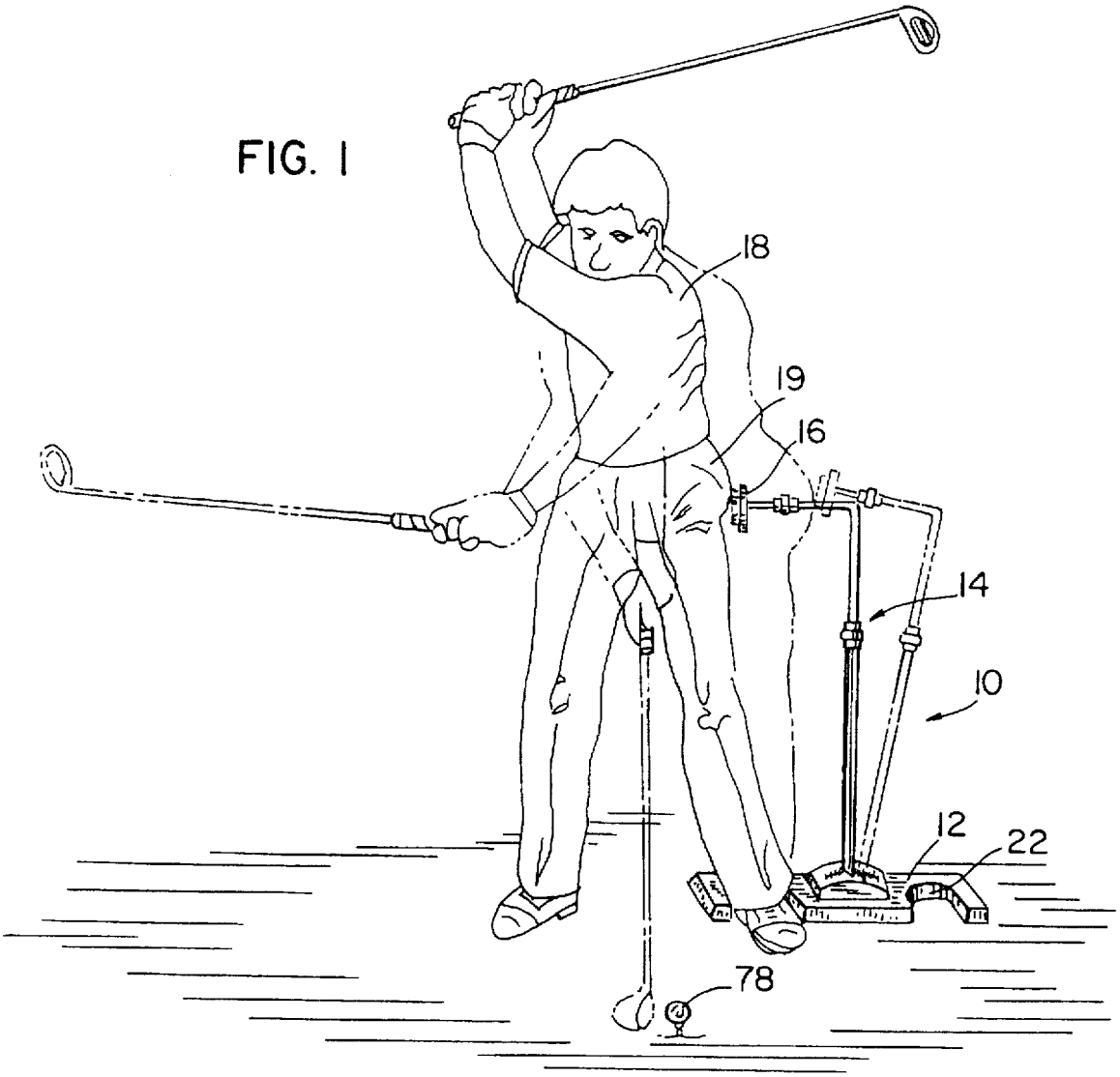
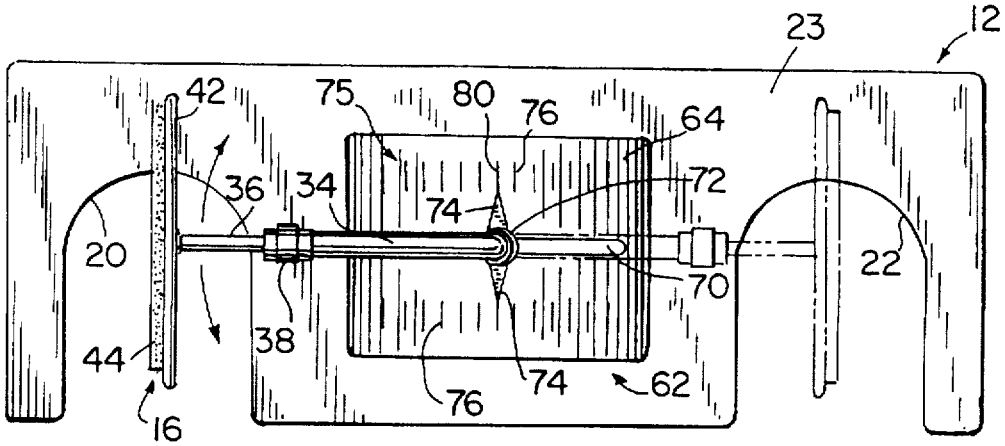
FIG. 2

GOLF SWING TRAINING DEVICE

FIELD OF THE INVENTION

This invention relates to a golf swing training device. More specifically, the invention relates to a golf swing trainer which is particularly useful in teaching the correct hip turn during the golf swing.

BACKGROUND OF THE INVENTION

During a typical golf swing, the golfer performs several complicated movements which must be perfectly coordinated in order to effectively strike the golf ball and accurately control the ball flight. Every golfer wants to improve his or her ball striking ability so as to provide increased accuracy and greater distance.

In a proper golf swing, the golfer pivots his hips and rotates about his back leg until he reaches the top of his back swing. During the following downswing, the golfer transfers his weight from his back leg to his front leg while rotating his hips to generate club head speed. An error which occurs in many golf swings is that, instead of rotating the hips during the downswing, the golfer "slides" his hips forward in a lateral direction which reduces the torque generated, and thus the power of the downswing. This sliding motion often produces an errant golf swing because the golfer's weight is not transferred properly from one leg to another. Sliding also reduces the maximum power present in a golf swing, which reduces the distance the golf ball will travel.

By improving his or her pivot so as to eliminate sliding motion of the hips, the golfer can increase the club head speed which results in greater power imparted to the golf ball, as well as greater accuracy of the stroke.

Sliding of the hips is a common problem which is difficult for the golfer to detect without the aid of a teaching professional, since it is hard for an individual golfer to monitor the movement of his or her hips. Therefore, it would be desirable to provide a teaching aid which provides a source of feedback corresponding to the amount of lateral hip movement present during the golf swing and which allows a golfer to monitor his or her progress toward the proper hip turn.

SUMMARY OF THE INVENTION

The invention is a golf swing training device that can be used by a golfer to determine the distance his or her front hip moves forward during a full golf swing in order to improve his or her hip turn to generate a more powerful golf swing.

The golf swing training device of the invention consists of a generally rectangular base which is positioned on the floor or ground. The base includes a pair of foot guides, such that the training device can be used by either a left-handed or a right-handed golfer. The device further includes a hip pad support structure which is pivotally mounted to the stationary base. The support structure includes a vertical arm extending upward from the base and a horizontal arm which extends at a right angle from the top of the vertical arm. A hip pad is connected to the end of the horizontal arm. Both the vertical arm and the horizontal arm are adjustable, such that the hip pad can be adjusted in both the vertical and horizontal direction depending on the size and physical characteristics of the golfer using the golf swing training device. The lower end of the vertical arm is connected to a pivot arrangement, such that the vertical arm can pivot about a horizontal axis. The pivot arrangement is preferably contained within a pivot housing, which is connected to a top flat face surface of the stationary base. The top surface of the pivot housing includes a visual guide consisting of a series of graduations or hash marks that provide a visual indication corresponding to the amount of movement of the vertical arm.

In a preferred embodiment of the invention, a sound generator is connected to the pivot arrangement, such that the sound generator generates a variable sound corresponding to the amount of movement of the hip pad. This sound generator provides immediate audio feedback to the golfer indicating the amount of hip movement present during the golf swing.

To use the golf swing training device, the golfer first positions his front heel in one of the foot guides contained in the stationary base. With his heel in place and in a proper golf stance, the golfer adjusts the hip pad until it slightly brushes against his front hip. Once the hip pad is correctly positioned, the golfer can make a full golf swing. During the downswing, if the golfer's front hip slides forward, it will contact the hip pad and cause the vertical arm to rotate about the pivot element. The golfer can then refer to either the visual gauge contained on the base or the audio feedback generated by the sound generator to determine the amount of forward hip movement present during the golf swing.

After finishing the golf swing, the golfer can again address the golf ball. A bias element, consisting of torsion spring connected to the pivot element, returns the vertical arm to the upright position after the force applied by the golfer's hip is removed. The torsion spring therefore repositions the hip pad in the position previously selected by the golfer. The golfer then can make another golf swing, attempting to correct the improper hip movement which was indicated by the golf swing training device in the previous swing. In this manner, the golfer receives immediate visual and/or audio feedback concerning the amount of lateral hip movement present during his golf swing. By concentrating on reducing the amount of forward hip movement, the golfer can learn to properly rotate his hips and create a more efficient golf swing.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a front view of a golfer using the golf swing training device of the invention showing the movement of the device during an improper golf swing;

FIG. 2 is a top plan view of the golf swing training device of FIG. 1, showing the hip pad in solid lines in a position to be used by a right-handed golfer and in phantom for a left-handed golfer;

DETAILED DESCRIPTION OF THE INVENTION

Figure 4:
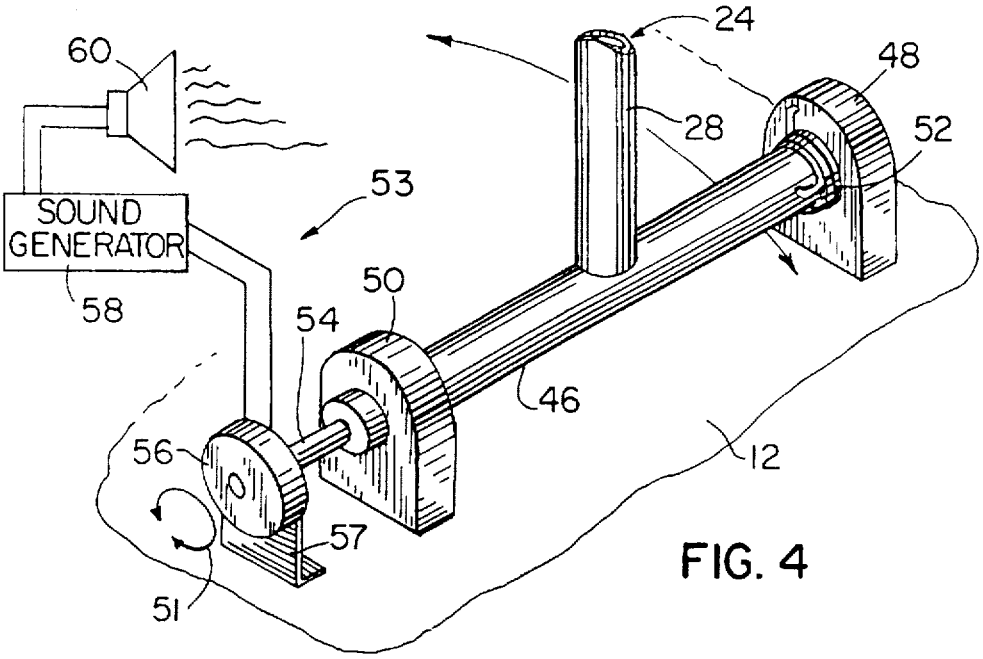
FIG. 4 is a partial isometric view of the pivot arrangement of the golf swing training device of FIG. 1 showing the audio movement indicator.

Referring to the drawings, the invention is a golf swing training device generally designated by the reference numeral 10. The golf swing training device 10 generally consists of a stationary base 12, a hip pad support structure 14 and a hip pad 16. Shown in FIG. 1 is a golfer 18 using the golf swing training device 10 to measure the distance which his front hip 19 slides forward during an improper golf swing.

Referring now to FIG. 2, the stationary base 12 is generally rectangular in shape and contains a pair of U-shaped foot guides 20 and 22 and a flat top surface 23. The foot guides 20 and 22 are sized to receive the heel and mid-portion of a golfer's shoe and function to correctly position the golfer with respect to the golf swing training device 10. The golf swing training device 10 is provided with a pair of foot guides such that it can be used by either a right-handed (FIG. 1) or a left-handed golfer. In the preferred embodiment of the invention, the stationary base 12 is constructed of durable molded plastic having an adequate weight to provide stable support during use.

Figure 3:
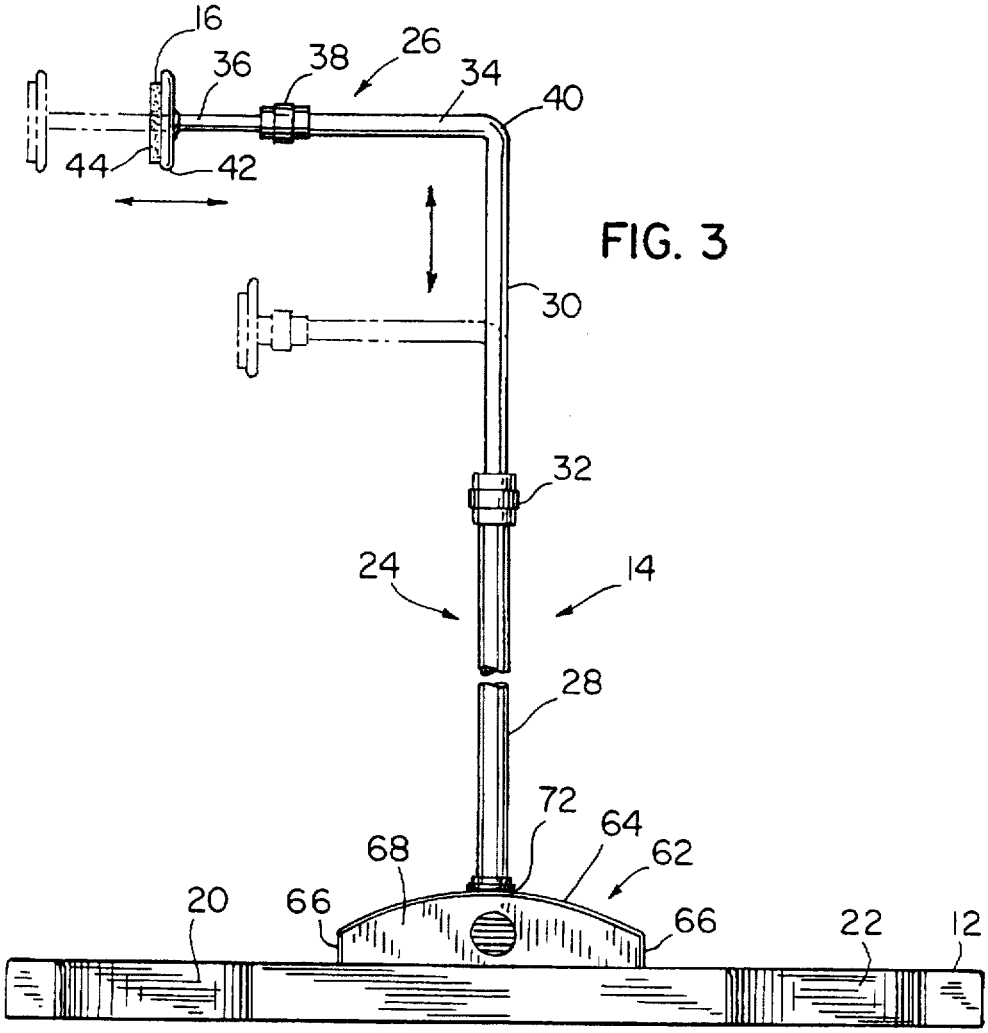
FIG. 3 is a front elevation view of the golf swing training device of FIG. 1 showing the possible horizontal and vertical adjustments of the hip pad.

Referring now to FIG. 3, the hip pad support structure 14 generally consists of an upright vertical arm 24 and a lateral horizontal arm 26 joined at a right angle to one another. The vertical arm 24 consists of a hollow tubular lower section 28 and a hollow tubular upper section 30. The inside diameter of the lower section 28 is larger than the outer diameter of the upper section 30 such that the upper section 30 fits inside the lower section 28. The upper section 30 can therefore move into and out of the lower section 28 in a telescoping manner, to provide vertical adjustment of the hip pad 16, as shown by the vertical arrow and phantom lines of FIG. 3.

A conventional threaded friction-type coupling 32 is connected to the upper end of lower section 28 and provides a releasable point of connection between the lower section 28 and the upper section 30. The coupling 32 can be loosened to allow the golfer to adjust the vertical position of the hip pad 16, depending on the height of the golfer. Once the hip pad 16 is in the desired vertical position, the coupling 32 is tightened to securely fix the height of the vertical arm 24. In the correct position, as shown in FIG. 1, the hip pad 16 is at a height corresponding to the front hip 19 of the golfer 18.

The horizontal arm 26 is likewise comprised of a hollow outer section 34 and an inner section 36. The inside diameter of the outer section 34 is larger than the outside diameter of the inner section 36, such that the outer section 36 can freely travel in a telescoping manner into and out of the inner section 34. In this manner, the hip pad 16 connected to the inner section 36 can be adjusted horizontally as shown by the horizontal arrow and phantom lines of FIG. 3.

A conventional threaded friction-type coupling 38 is connected to the end of outer section 34 and provides a releasable point of connection between the outer section 34 and the inner section 36. The coupling 38 can be loosened to allow the golfer to adjust the horizontal position of the hip pad 16, depending on the physical characteristics of the golfer. Once the hip pad 16 is in the desired position, the coupling 38 is tightened to fix the length of the horizontal arm 26. In the correct position, as shown in FIG. 1, the hip pad 16 touches the front hip 19 of the golfer 18.

As shown in FIG. 3, in the preferred embodiment of the invention the outer section 34 of the horizontal arm 26 and the upper section 30 of the vertical arm 24 are a single structure containing a right angle bend 40.

Referring again to FIGS. 2 and 3, the coupling 32 not only allows for the vertical adjustment of the hip pad 16, but it also allows the horizontal arm 26 to rotate about a pivot axis coincident with the longitudinal axis of vertical arm 24. Hip pad 16 can be rotated from the first position shown by solid lines in FIG. 2 to a second position shown by the phantom lines in FIG. 2. This rotation of hip pad 16 allows the golf swing training device 10 to be used by both a right-handed and a left-handed golfer. As shown in FIG. 1, a right-handed golfer positions his front left foot in the foot guide 20. A left-handed golfer, on the other hand, would place his front right foot in the foot guide 22 and would rotate the hip pad 16 to the position shown by the phantom lines in FIG. 2.

The hip pad 16 is preferably constructed of a solid plastic back 42 joined to a foam pad 44 or the like which contacts the golfer's hip 19. As shown in FIGS. 2 and 3, the back 42 is securely connected to the end of horizontal arm inner section 36 by any known method, such as an adhesive or a heat weld.

FIG. 4 shows a preferred embodiment of the pivotal connection between the vertical arm 24 and the stationary base 12. The lower end of vertical arm lower section 28 is joined to a horizontal pivot rod 46 in approximately the longitudinal center of the pivot rod 46. The pivot rod 46 is pivotally supported on each end by a pair of support brackets 48 and 50. The horizontal pivot rod 46 thereby enables the vertical arm 24 to pivot about a horizontal pivot axis defined by the longitudinal axis of pivot rod 46, as indicated by arrow 51 as shown in FIG. 4.

Preferably, a bias element, such as a torsion spring 52 is connected to one of the support brackets, such as bracket 48, at one end and to the horizontal pivot rod 46 at the other end. The torsion spring 52 is connected such that the vertical arm 24 is biased toward an upright vertical position when no force is applied to the hip pad 16. Therefore, in the resting position, the vertical arm 24 is in the upright position as shown in FIG. 3.

Although the pivotable connection between the vertical arm 24 and the stationary base 12 has been specifically described with reference to the embodiment shown in FIG. 4, it is understood that any equivalent method of providing a pivotal relationship between the vertical arm 24 and the base 12 is within the scope of the invention.

The horizontal pivot rod 46 is preferably connected to an audio movement indicator 53 as shown in FIG. 4. The audio movement indicator 53 consists of a connection rod 54 extending between one end of the horizontal pivot rod 46 and a rheostat 56, which is securely mounted to the stationary base 12 by a support structure 57. The rheostat 56 is connected to a sound generator 58 which, in turn, is connected to a speaker 60. A battery (not shown) or other power source is interconnected with sound generator and speaker 60 to provide electrical power to such components. Sound generator 58 is well known in the prior art and hence is indicated only by a box in FIG. 4.

Movement of the vertical arm 24 causes the horizontal pivot rod 46 to rotate which, in turn, rotates the rheostat 56 to increase or decrease the resistance of the rheostat 56. The change in resistance of the rheostat 56 causes the sound generator 58 to generate a sound of an increasing or decreasing pitch or volume. The changing sound, therefore, gives the golfer audio feedback of the position of the vertical arm 24 and thus the amount of lateral hip movement present during the golf swing. Preferably, the sound generator 58 will not generate any sound when the vertical arm 24 is in its upright resting position.

A pivot housing 62 surrounds the pivot arrangement as can best be seen in FIGS. 2 and 3. The pivot housing 62 is preferably a plastic structure having an arcuate top wall 64, a pair of parallel end walls 66 and a pair of parallel side walls 68. As can best be seen in FIG. 2, the vertical arm 24 passes through a slot 70 formed in the arcuate top wall 64. Slot 70 extends throughout almost the entire length of arcuate top wall 64, such that the vertical arm 24 can freely pivot about the horizontal pivot rod 46 throughout a wide range of pivot positions in both directions relative to its vertical upright position.

A fixed indicator 72 is securely connected to the lower section 28 of the vertical arm 24 slightly above the arcuate top wall 64. The arcuate top wall 64 has a radius of curvature such that the indicator 72 remains a fixed distance above the top wall 64 as the vertical arm 24 pivots about the pivot rod 46. The indicator 72 contains a pair of pointers 74 which extend outward from the indicator 72. The pointers 74 indicate the position of the vertical arm 24 along a visual movement indicator 75 consisting of a series of graduations or hash marks 76 contained on the arcuate top wall 64. The hash marks 76 are equally spaced and provide a point of reference to gauge the movement of the hip pad 16 during the execution of the golf swing.

The operation of the golf swing training device 10 will now be described. The golfer 18 first positions the golf swing training device 10 in a location where the golfer 18 is able to make a full golf swing. The golfer 18 then positions the heel of his front foot in either the foot guide 20 or the foot guide 22, depending on whether the golfer is left- or right-handed. For example, as shown in FIG. 1, a right-handed golfer positions the heel of his left foot in the foot guide 20.

With his or her heel in place, the golfer 18 then addresses a golf ball, shown at 78, as if he were about to make a golf swing. The golfer then adjusts the horizontal and vertical position of the hip pad 16 until it brushes against his or her front hip 19. The horizontal position of the hip pad is adjusted by loosening the coupling 38, which allows the inner section 36 of the horizontal arm 26 to be moved into and out of the outer section 34. The vertical position of the hip pad 16 is adjusted by loosening the coupling 32, which allows the upper section 30 to be moved into and out of the lower section 28 of the vertical arm 24. Once the hip pad is correctly positioned, both of the couplings 32 and 38 are tightened to secure the position of hip pad 16. If the golf swing training device 10 is properly adjusted, vertical arm 24 will be in its vertical resting position and the pointers 74 will be aligned with the center hash mark 80 when the golfer addresses the golf ball 78.

With the hip pad 16 properly adjusted, the golfer 18 can now use the golf swing training device 10 to analyze his or her hip movement during a golf swing. In a perfectly executed golf swing, the front hip 19 of the golfer 18 will not move forward, but will instead rotate to create torque which increases the club head speed during the swing. In an improperly executed golf swing, the golfer's front hip 19 will travel forward during the downswing, as shown in phantom in FIG. 1.

As the golfer's front hip 19 moves forward, force is applied to the hip pad 16. This force causes the vertical arm 24 to rotate about the horizontal pivot rod 46 contained within the pivot housing 62. The lower section 28 of the vertical arm 24 travels within the slot 70 contained in the top wall 64 of the pivot housing 62.

As the horizontal pivot rod 46 rotates, the connection rod 54 causes the rheostat 56 to rotate accordingly. The change in resistance of the rheostat 56 as it rotates causes the sound generator 58 to produce an audible signal. The sound generator 58 is designed in a known manner to produce an audible signal that varies in either pitch or volume as the rheostat 56 is rotated. Therefore, as the golfer 18 moves the hip pad 16 during the golf swing, he or she is able to hear a sound which changes in pitch or volume depending on the distance the hip pad 16 moves. This audio feedback gives the golfer an immediate indication of the amount his or her hips move forward during the golf swing.

When the golfer 18 completes his golf swing, he or she can look down at the series of hash marks 76 contained on the top wall 64 of the pivot housing 62. The distance the pair of pointers 74 travels from the center hash mark 80 is related to the amount of distance the golfer moves his hips during the golf swing. By monitoring this distance through successive golf swings, the golfer 18 can learn to adjust his swing in order to reduce the distance his or her hips 17 travel forward and, therefore, improve his or her swing.

If desired, a sliding pointer-type indicator may be interconnected with pivot housing top wall 64 for engagement by vertical arm 24 to provide a visual indicator of hip movement even after arm 24 returns to its vertical resting position. Such an indicator would have to be returned by the user to a reset position subsequent to each time it is moved, and provides an additional source of hip movement feedback to the user.

If a left-handed golfer wishes to use the golf swing training device 10, he or she first loosens the coupling 32 and rotates the horizontal arm 26 180° until it is in the position shown by the phantom lines in FIG. 2. The left-handed golfer can use the golf swing training device 10 in a similar manner as previously described. As shown in FIG. 2, hash marks 76 extend in both directions from the center hash mark 80, such that the device provides an indication of hip movement for both a left-handed or a right-handed golfer. Additionally, the rheostat 56 can be operated in either direction as shown by the arrow 51 in FIG. 4.

The present invention and its advantages will be understood from the foregoing description and it will be apparent that various changes may be made thereto without department from the spirit and scope of the invention as defined in the appended claims, the form hereinbefore described being merely a preferred or exemplary embodiment thereof.

I claim:

1. A golf swing training device to be used by a golfer making a golf swing, comprising:

a stationary base;

a hip engagement member positioned to contact the front hip of the golfer when the golfer addresses the golf ball;

a support structure defining a first end pivotally connected to the stationary base for pivoting movement about a substantially horizontal pivot axis and a second end supporting the hip engagement member; and a hip movement indicator providing feedback corresponding to the distance the hip engagement member moves during a completed golf swing.

2. The golf swing training device of claim 1, wherein the support structure is adjustable in both a vertical and a horizontal direction to correctly position the hip engagement member relative to the front hip of the golfer.

3. The golf swing training device of claim 1, further comprising at least one foot guide formed in the stationary base.

4. The golf swing training device of claim 1, wherein the support structure comprises an upwardly extending arm pivotally connected to the base about the horizontal pivot axis and a lateral arm extending from the upwardly extending arm.

5. The golf swing training device of claim 4, further comprising a bias element for positioning the upwardly extending arm of the support structure in an upright vertical position when no force is applied to the hip engagement member.

6. The golf swing training device of claim 5 wherein the bias element is a torsion spring surrounding the pivotal connection between the first end of the support structure and the stationary base, such that the torsion spring biases the support structure into the upright vertical position when no force is applied to the hip engagement member and the torsion spring exerts a force to oppose the pivotal movement of the support structure about the horizontal pivot axis.

7. The golf swing training device of claim 4, wherein the lateral arm is rotatable relative to the upwardly extending arm, such that the golf swing training device can be configured for use by both right-handed and left-handed golfers.

8. The golf swing training device of claim 1, wherein the movement indicator comprises a visual gauge mounted to the base, the visual gauge indicating the amount of movement of said hip engagement member relative to the stationary base.

9. The golf swing training device of claim 1, wherein the hip movement indicator generates a variable audio output corresponding to the amount of movement of the hip engagement member.

10. A golf swing training device to be used with a golfer making a golf swing, comprising:

a stationary base having at least one foot guide formed in the base;

a hip pad support structure pivotally connected to the base for pivoting movement about a substantially horizontal pivot axis, the hip pad support structure having an adjustable lateral arm and an adjustable upright arm, the lateral arm being rotatable about an axis passing through the upright arm;

a hip pad connected to the lateral arm, the hip pad being engageable by the front hip of the golfer, wherein the hip pad support structure pivots about the pivotal connection between the hip pad support structure and the base in response to a force applied to the hip pad resulting from the forward movement of the front hip of the golfer during a golf swing; and a hip movement indicator providing feedback corresponding to the distance the hip pad moves during a completed golf swing.

11. The golf swing training device of claim 10, wherein the hip pad support structure is pivotally connected to the base via a pivot element secured to a lower end of the upright arm and connected to the base for pivoting movement about a substantially horizontal pivot axis.

12. The golf swing training device of claim 11, wherein the pivot element includes a bias element which positions the upright arm in an upright vertical position when no force is applied to said hip pad.

13. The golf swing training device of claim 10, wherein the hip movement indicator comprises a visual gauge mounted to the base, the visual gauge including a series of hash marks.

14. The golf swing training device of claim 13, wherein the hip movement indicator further comprises a sound generator, the sound generator emitting a variable audio tone corresponding to the amount of movement of the hip pad.

15. The golf swing training device of claim 10, wherein the hip movement indicator comprises a sound generator, the sound generator emitting a variable audio tone corresponding to the amount of movement of the hip pad.

16. A golf swing training device for use by a golfer, comprising:

a hip engagement member for positioning adjacent a front hip of a golfer;

a base engageable with a supporting surface, the hip engagement member being pivotably mounted to the base about a substantially horizontal pivot axis for providing lateral movement of the hip engagement member upon lateral movement of the front hip of the golfer during a golf swing; and an indicator arrangement interconnected with the hip engagement member for providing an indication of forward movement of the golfer's hips during a golf swing, the indicator arrangement including a sound generator and a visual gauge including a series of hash marks, the sound generator emitting a variable audio tone corresponding to the amount of movement of the hip engagement member such that both the visual gauge and the sound generator provide feedback corresponding to the distance the front hip of the golfer moves during a golf swing.

17. The golf swing training device of claim 16, further comprising positioning means associated with the base and engagement with a foot of the golfer for establishing the position of the golfer relative to the base.

18. A golf swing training device to be used by a golfer making a golf swing, comprising:

a stationary base having at least one foot guide formed in the base;

a hip engagement member positioned to contact the front hip of the golfer when the golfer addresses a golf ball with a foot positioned in the foot guide;

a support structure defining a first end pivotally connected to the stationary base and a second end supporting the hip engagement member; and a hip movement indicator providing feedback corresponding to the distance the hip engagement member moves during a completed golf swing.

19. A golf swing training device to be used by a golfer making a golf swing, comprising:

a stationary base;

a hip engagement member positioned to contact the front hip of the golfer when the golfer addresses the golf ball;

a support structure defining a first end pivotally connected to the stationary base and a second end supporting the hip engagement member, the support structure being pivotable within a range of motion in response to the movement of the front hip of the golfer during a completed golf swing; and a hip movement indicator providing feedback corresponding to the amount the support structure rotates within the range of motion to provide the golfer with feedback corresponding to the amount of hip movement present during a completed golf swing.

* * * * *